US006935896B1

(12) United States Patent
Tsai

(10) Patent No.: US 6,935,896 B1
(45) Date of Patent: Aug. 30, 2005

(54) HIGH DEFINITION MULTIMEDIA INTERFACE CONNECTOR

(75) Inventor: Wen Hsien Tsai, Taipei Hsien (TW)

(73) Assignee: Advanced Connectek Inc., Ltd., Taipei Hsien (TW)

( * ) Notice: Subject to any disclaimer, the term of this patent is extended or adjusted under 35 U.S.C. 154(b) by 0 days.

(21) Appl. No.: 10/708,447

(22) Filed: Mar. 4, 2004

(51) Int. Cl.[7] ..... H01R 13/648
(52) U.S. Cl. ..... 439/607; 439/541.5
(58) Field of Search ..... 439/607–610, 439/541.5, 939, 901

(56) References Cited

U.S. PATENT DOCUMENTS 6,527,564 B1 * 3/2003 Yeh ..... 439/76.1
6,540,563 B1 * 4/2003 Hu et al. ..... 439/676
6,561,847 B1 5/2003 Xiang et al. ..... 439/541.5
6,595,801 B1 * 7/2003 Leonard et al. ..... 439/607
6,629,859 B2 * 10/2003 Hoshino et al. ..... 439/607
6,688,914 B1 * 2/2004 Espenshade et al. ..... 439/541.5
6,709,286 B1 * 3/2004 Korsunsky et al. ..... 439/557
2004/0127091 A1 * 7/2004 Naito et al. ..... 439/488

* cited by examiner

*Primary Examiner*—Michael C. Zarroli

(57) ABSTRACT

The present invention provides a high definition multimedia interface (HDMI) connector comprising an insulated housing assembly, a metallic housing assembly, a plastic outer shell and a front cover, wherein the insulated housing assembly consists of an insertion portion and a wiring block, and said metallic housing assembly consists of a metallic front shell and a metallic rear shell.

17 Claims, 4 Drawing Sheets

HIGH DEFINITION MULTIMEDIA INTERFACE CONNECTOR

BACKGROUND OF THE INVENTION

1. Field of the Invention

The present invention relates to a high definition multimedia interface (HDMI) connector, and more specifically to a small connector utilized in digital TV, DVD player, deck-top box (video signal converter), and other digital Audio/Video (AV) product.

2. Description of the Related Art

LCD in nowadays has become a most popular output device for Audio/Video (AV) product. Since it plays an important role in the production of modern PC monitor and TV display, and in the light of connector for digital signal transmission has become a mainstream product in LCD industries, the HDMI connector of the invention is thus created to serve this purpose. The HDMI (High Definition Multimedia Interface) is a transmission interface utilized for the transmission of a high definition multimedia digital signal including high fidelity image and multi-channel audio signal. The earliest specification of the HDMI was established by several Audio/Video industries, such as HITACHI, Panasonic, Philips, Sony, Silicon Image, Thomson and Toshiba. It established the most frequently used standard specification based on DVI (Digital Visual Interface) for digital image signal transmission. The object of the invention is to transmit a digital screen signal between PC and LCD and display a live scene on LCD with high fidelity.

Furthermore, the digital image signal transmitted by DVI also provides the effect of unauthorized copy proof, and its signal may be encoded at the transmitting end and decoded at receiving end that will provide the effect of preventing unauthorized reproduction of the image signal being transmitted. Although DVI improved the resolution and quality of picture on a LCD screen, however, DVI is not absolutely perfect, because it didn't take the transmission of digital audio signal into account so far, therefore users need to connect additional line or use traditional AV terminal for signal transmission. This may not raise the question of compatibility among the signal transmission in the application of personal computer, but it does cause chaos when used in the family theater set which is getting more and more popular among the consumers.

Furthermore, as the digital products such as digital video camera and digital electronic camera are prevailed, it may become bothersome that if LCD TV requires a plurality connection lines. This may also increase the number of installation components for family theater sets, and further increase the price of product. Therefore, the HDMI of the present invention is thus created for family theater set to eliminate the flaws of DVI mentioned above. The HDMI of the present invention is not only in compliance with the standard specification of DVI but also take digital audio signal into account in the design of HDMI connector, which is not only fully compatible with DVI but also capable of transmitting uncompressed data of digital AV signal without distortion. Furthermore, the HDMI also has advantages, such as, it complies with all kinds of video format specification used in the market, thus, it is capable of communicating with all kinds of product by all kinds of video transmission formats.

Therefore, the HDMI provides the best quality and high fidelity video signal for consumer AV products, and because it supports all kinds of transmission format of digital video signal, resulted in less cable and smaller connector for the transmission of uncompressed data. Furthermore, the HDMI also succeeded the feature of unauthorized copy proof of DVI. It will alleviate the burden of movie filmmakers worrying that the export of the highest quality video products will come across with unauthorized reproduction by piracy. The HDMI connector also provides two-way communication for digital TV, DVD player, deck top box (signal converter) and other small connectors of digital AV products. The advantage is that the player provides the best image quality through determining which format is suitable for the received signal automatically. The HDMI connector is more convenient to install inside different AV products, because it is designed to reduce the volume of interface connector significantly. It is known from the mentioned above that the HDMI will be a mainstream connector for AV product in the future. The HDMI will be the first AV standard specification supported throughout the software supplier, system provider and CE (Consumer Electronics) makers in a chain link. Therefore, the HDMI connector needs to be built with a strong construction to comply with the demand of high-speed transmission. The object of the invention is to provide such new type of connector construction for the newly developed system.

SUMMARY OF INVENTION

The main object of the present invention is to provide a connector for high definition multimedia digital transmission interface. It utilizes a cable connecting means to firstly place the cable in the inner guide slot of the wiring block. The cable will be fixed in a secured array and convenient for soldering automatically.

Another object of the invention is to provide a high definition multimedia interface connector, wherein a protrusion and a latch hole were prefabricated respectively on a front and a rear metallic housing assembly for a prompt latch action for the front and the rear shell while receiving an insulated housing assembly therein.

Further object of the invention is to provide a high definition multimedia interface connector with an outer shell and a front cover to accommodate the front and rear shells by means of engagement of buckles and notches to enable a prompt latch action for the plastic outer shell and the front cover.

To achieve above objects, the HDMI connector in accordance with the present invention comprises an insulated housing assembly, a metallic housing assembly, and a plastic outer shell, wherein the insulated housing assembly further consists of an insertion portion and a wiring block.

When a terminal is inserted in the insertion portion, both are latched and secured by means of a multiple locking mechanism. After the combination of the insulated housing assembly is completed, the inserted portion of the insulated housing assembly is inserted into the metallic front shell, the metallic front shell and the insulated housing assembly are further combined by means of engagement of a latch slot at the rear end of the metallic front shell and a latch lug on the insertion portion of the insulated housing assembly, followed by incorporating the combined assembly with the metallic rear shell by means of engagement of the protrusion on the metallic front shell and the latch hole on the metallic rear shell to form a compact assembly.

When the insulated housing assembly and the metallic rear shell are in place, an inward projection at two sides of the metallic rear shell is thrust against the flange of the metallic front shell to avoid the metallic housing assembly being loose thereof.

Finally, the metallic shell assembly is engaged in the plastic outer shell, and the front cover is attached around the rear part of the metallic front shell, wherein the metallic shell assembly is fixed in the plastic outer shell by means of engagement of the buckles on the front cover and the notches at the front end of the plastic outer shell, and the assembly of the HDMI connector is completed.

The present invention will be readily apparent to those skilled in the art upon reading the following description of a preferred embodiment of the present invention and upon reference to the accompanying drawings.

DETAILED DESCRIPTION

Figure 1:
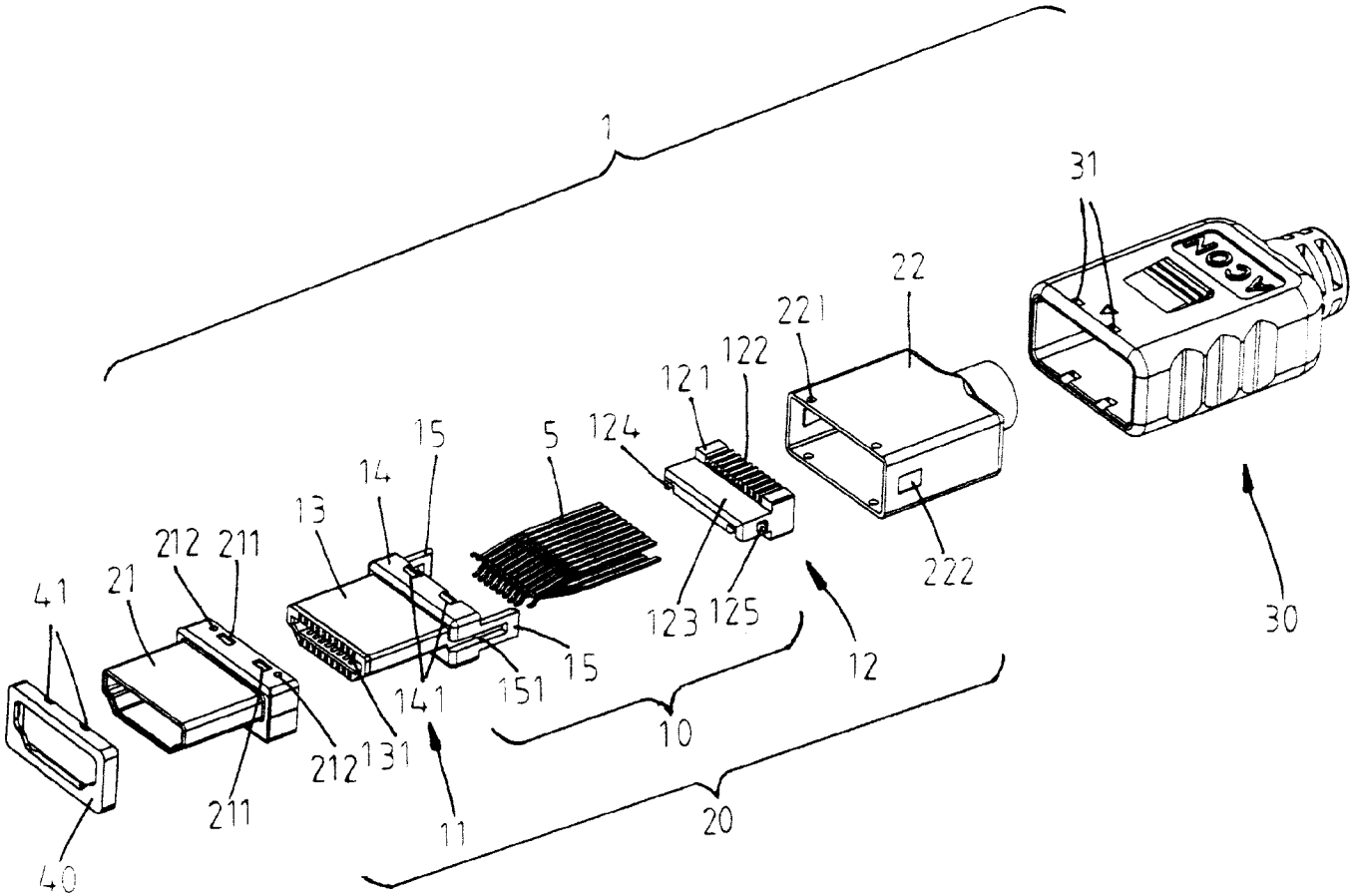
FIG. 1 is an exploded view of a HDMI connector in accordance with the present invention.
Figure 2:
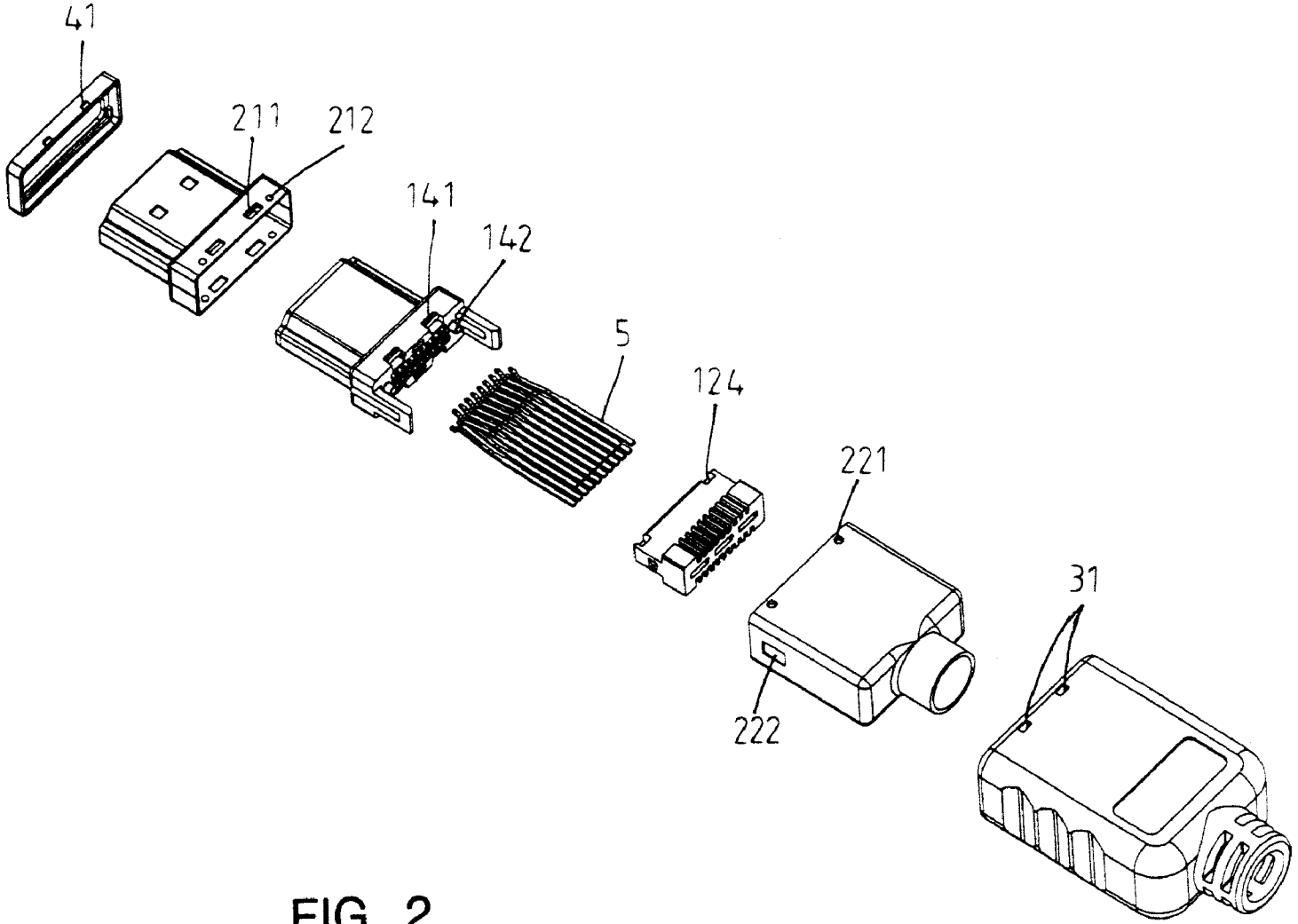
FIG. 2 is an exploded view on the reverse side of a HDMI connector in accordance with the present invention.

With reference to FIG. 1 and FIG. 2, wherein a HDMI connector 1 comprises an insulated housing assembly 10, a metallic housing assembly 20, a plastic outer shell 30, and a front cover 40. The insulated housing assembly 10 consists of an insertion portion 11 and a wiring block 12, and the insertion portion 11 is an insertion place for a terminal 5.

The structure of the insertion portion 11 consists of an insertion front 13 at front part and a retainer 14 at rear part thereof. The insertion front 13 is a flat projecting body, which provides two terminal receptacle slots 131 aligned at its top and bottom sides extended from the insertion front 13 at the front part to the retainer 14 at the rear part thereof, and utilizing the curved contour shape at the bottom of both sides of the projecting body to form an accuracy error proof retainer.

The retainer 14 jointly constitutes a rectangular body through connection with the insertion front 13. A plurality of latch lugs 141 embedded on the top and bottom ends are engaged with the latch slots 211 furnished on the metallic front shell 21, and positioning poles 142 are furnished at the end of the rectangular body, and a parallel stop plate 15 having a hollowed stop slot 151 is extended at the both sides of the rectangular body. A wiring block 12 is a T shape body oriented in horizontal direction having a plurality of guide slots 122 on the side surface of the perpendicular block 121. The number and the position of the guide slots 122 are in correspondence with the terminal receptacle slots 131 mentioned above. A positioning slot 124 is arranged at the bottom of a flat block 123 in front of the T shape body, wherein positioning slots 124 and positioning poles 142 on the topside of the rectangular body are correspondingly engaged each other, while latch points 125 furnished on the both sides of the T shape body are thus designed to latch with hollowed stop slots 151 erected on stop plates 15 of the rectangular body.

The metallic housing assembly 20 consists of a front and a rear portions and the configuration of a metallic front shell 21 is similar to the insertion portion 11 of the insulated housing assembly 10 in order to accommodate the insertion portion 11 therein. A plurality of latch slots 211 and protrusions 212 are furnished on the long side surface of the rectangular body of the metallic front shell 21, wherein the latch slots 211 are engaged with the latch lugs 141 of the retainer 14 of the insulated housing assembly 10 mentioned above, and the protrusions 212 are engaged with latch holes 221 furnished on the metallic rear shell 22. The metallic rear shell 22 is a rectangular body having a hollow front portion and a hollow cylinder at rear part with a sufficient space to receive cablings.

The latch holes 221 are furnished at the front end of both top and bottom wide surface, the positions of the latch holes 221 and the protrusions 212 on the metallic front shell 21 are correspondingly matched. And a slanting inward projection 222 is furnished at a feasible position of both sides of the narrow surface to retain the rectangular end side of the received metallic front shell 21. This will prevent the metallic front shell and metallic rear shell 21,22 from further longitudinal displacement for loose inner space of the metallic rear shell 22 during combination operation thereof.

The plastic outer shell 30 is adapted to receive the metallic rear shell 22 containing the metallic front shell 21 for firmly covering the both therein. There also constitutes a plurality of notches 31 on the front end of the top and bottom sides of the plastic outer shell 30, and the number and position of notches 31 and buckles 41 on the front cover 40 are correspondingly matched. The front cover 40 has an opening similar to the insertion portion 11 and metallic front shell 21, so it may confine the rear part of the metallic front shell 21 and retain it at the rectangular part of the metallic front shell 21, and the buckles 41 are furnished on the top and bottom sides of the frame of the front cover 40. The terminal 5 is a typical component frequently used, therefore, it will not be described recurrently hereinafter.

The assembly process of the preferred embodiment of the present invention is carried out from inside out. The first step of assembly is inserting the cable wires into the plastic outer shell 30 and metallic rear shell 22, followed by inserting the terminal 5 firstly into the terminal position slot 131 inside the insertion process 11 of the insulated housing assembly 10, and then the wiring block 12 is aligned with the insertion portion 11 at the rear half part of the retainer 14 and inserted therein, in turn, the positioning slots 124 on the flat block 123 of the wiring block 12 match with the positioning poles 142 on the rectangular part of the retainer 14.

As a result, the top and bottom sides of the flat block 123 are inserted inside the terminal 5 against the top and bottom rows of the same respectively, and the latch points 125 on both T shape side surfaces of wiring block 12 are also latched with the hollowed stop slots 151 on the stop plate 15 of the retainer 14. The insertion portion 11 of the insulated housing assembly 10 and the rear wiring block 12 may thus obtain a stable fixation through those multiple positioning and locking mechanism securing the terminal within. Then, the cable wires to be welded with terminal 5 is placed in the guide slot 122 on the wiring block 12, the cable wires and terminal 5 are connected by welding the cable wires onto the terminal 5.

Figure 3:
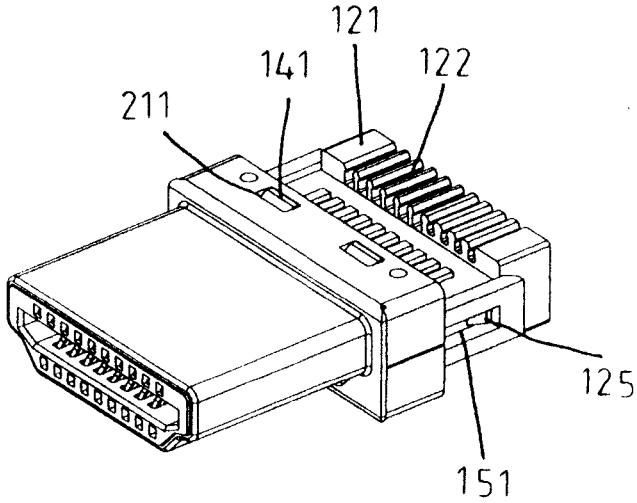
FIG. 3 is an assembled view of FIG. 1 at the first stage.

The first assembly step is thus completed as shown in the FIG. 3. The second step of assembly is firstly to combine the metallic front shell 21 with the part assembled in the first step, and the latch slots 211 on the rectangular part of the metallic front shell 21 incorporate with the latch lugs 141 of the retainer 14 of the insulated housing assembly 10, thus the metallic front shell 21 is combined with the assembled parts, and followed by inserting the combined parts into the metallic rear shell 22 with the cable wires passing through therein. The protrusions 212 on the rectangular part of the metallic front shell 21 are latched with latch holes 221 on the metallic rear shell 22, therefore, the metallic front and rear shell 21, 22 are prevented from further vertical displacement by means of the slanting inward projection 222 on both sides of the metallic rear shell 22 thrusting against the side edge of the rectangular part of the accommodated metallic front shell 21.

Figure 4:
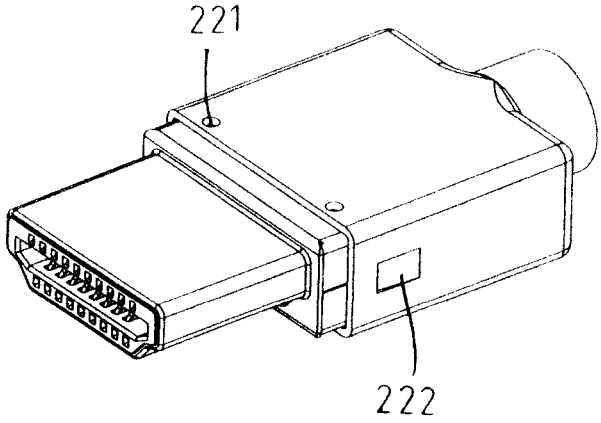
FIG. 4 is an assembled view of FIG. 1 at the second stage.
Figure 5:
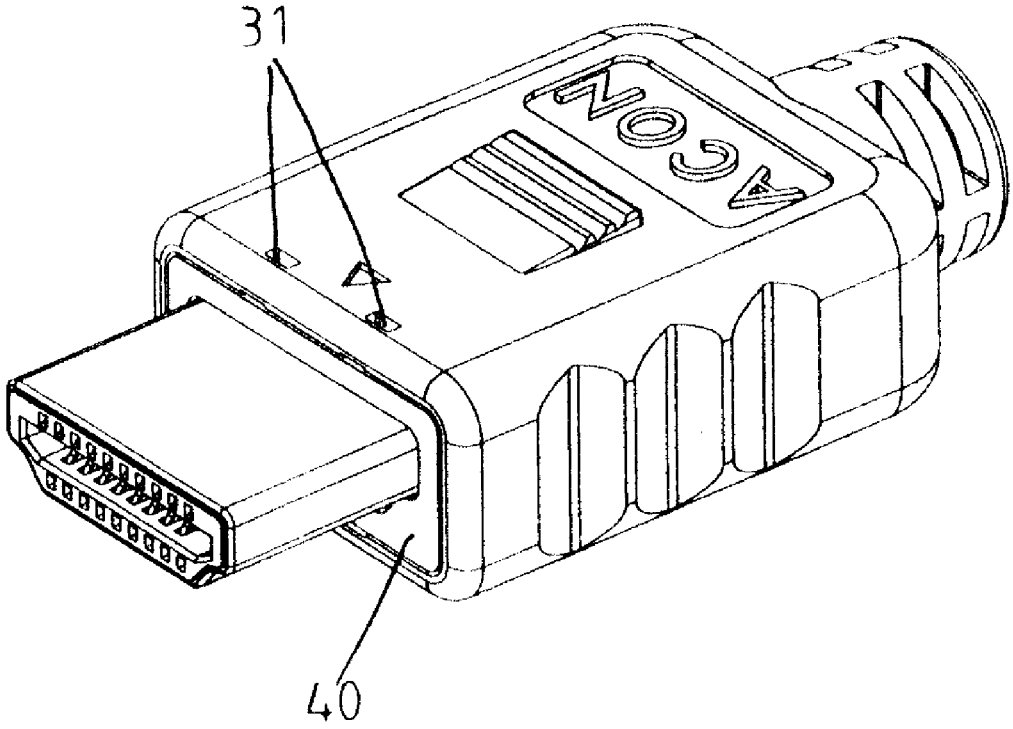
FIG. 5 is an assembled view of FIG. 1 at the final stage.

The second step of assembly is thus completed as shown in FIG. 4. The third step of assembly is to attach the front cover 40 around the previously assembled metallic front shell 21 of the metallic housing assembly 20 to retain the rectangular part of the metallic front shell 21, and move the assembled part into the plastic outer shell 30 with the cable wires passing through therein. Finally, the whole assembly of metallic housing assembly 20 is fixed firmly in the plastic outer shell 30 by means of engagement of the buckles 41 on the front cover 40 latched with the notches 31 on the plastic outer shell 30, and the complete assembly of the connector is accomplished as shown in FIG. 5.

From the above description it is understood that the HDMI connector of the present invention is thus fabricated and assembled to form a rigid and compact structure in compliance with the strict requirements. Although the present invention has been described with reference to a preferred embodiment thereof, it is apparent to those skilled in the art that there are a variety of modifications and changes that may be made without departing from the scope of the present invention which is intended to be defined by the appended claims.

What is claimed is:

1. A high definition multimedia interface (HDMI) connector comprising:

an insulated housing assembly (10) consisting of an insertion portion (11) and a wiring block (12) adapted to fix a terminal (5) therein by use of a retainer (14) of the insertion portion (11) and a flat block (123) of the wiring block (12);

a metallic housing assembly (20) consisting of a metallic front shell (21) and a metallic rear shell (22) adapted to accommodate the insulated housing assembly (10) in the metallic front shell (21) by means of engagement of a latch slot (211) at the rear end of the metallic front shell (21) and a latch lug (141) on the insertion portion (11) of the insulated housing assembly (10), and further combined with the metallic rear shell (22) by means of engagement of a protrusion (212) on the metallic front shell (21) and a latch hole (221) on the metallic rear shell (22), wherein a slanting inward projection (222) at two sides of the metallic rear shell (22) is thrust against the flange of the metallic front shell (21) to avoid the metallic housing assembly (20) made loose thereof;

a plastic outer shell (30) adapted to secure the assembled insulated housing assembly (10) and metallic housing assembly (20); and a front cover (40) attached around the rear part of the metallic front shell (21) in flush with the front edge of the metallic rear shell (22) to combine with the plastic outer shell (30) by means of engagement of buckles (41) on the front cover (40) and notches (31) at the front end of the plastic outer shell (30).

2. A high definition multimedia interface (HDMI) connector as claimed in claim 1, wherein the insertion portion (11) consists of the insertion front (13) at front part and the retainer (14) at rear part.

3. A high definition multimedia interface (HDMI) connector as claimed in claim 2, wherein the insertion front (13) is a flat projection body, which provides two terminal receptacle slots (131) aligned at its top and bottom side extended throughout the portion from the insertion front (13) at the front part to the retainer (14) at the rear part, and utilizing the curved contour shape at the bottom of both sides of the projecting body to form the retainer.

4. A high definition multimedia interface (HDMI) connector as claimed in claim 2, wherein the retainer (14) jointly through connection with the insertion front (13) constitutes a rectangular body having a plurality of latch lug (141) embedded on the top and bottom end, a positioning pole (142) furnished at the end of the rectangular body, and a parallel stop plate (15) having a hollowed stop slot (151) extending at the both sides of the rectangular body.

5. A high definition multimedia interface (HDMI) connector as claimed in claim 4, wherein the latch lug (141) is engaged with the latch slot (211) on the metallic front shell (21) to form a retaining means.

6. A high definition multimedia interface (HDMI) connector as claimed in claim 1, wherein the wiring block (12) is a T shape body having a plurality of guide slots (122) on the side surface of the perpendicular block (121), a positioning slot (124) arranged at the bottom of the flat block (123) in front of the T shape body, and the latch points (125) furnished on the both sides of the T shape body.

7. A high definition multimedia interface (HDMI) connector as claimed in claim 6, wherein the number and the position of the guide slots (122) are in correspondence with the terminal receptacle slots (131).

8. A high definition multimedia interface (HDMI) connector as claimed in claim 6, wherein the positioning slot (124) and the positioning pole (142) on the topside of the rectangular body are engaged to form a retaining means.

9. A high definition multimedia interface (HDMI) connector as claimed in claim 6, wherein the latch points (125) are furnished on the both sides of the T shape body latch with the hollowed stop slots (151) on the stop plate (15) of the rectangular body to form a retaining means.

10. A high definition multimedia interface (HDMI) connector as claimed in claim 1, wherein the front and rear portions and the configuration of the metallic front shell (21) are similar to the insertion portion (11) of the insulated housing assembly 10 for accommodating the insertion portion (11) therein, and a plurality of latch slots (211) and protrusions (212) are furnished on the long side surface of the rectangular body of the metallic front shell (21).

11. A high definition multimedia interface (HDMI) connector as claimed in claim 10, wherein the latch slots (211) are engaged with the latch lugs (141) of the retainer (14) of the insulated housing assembly (10), and the protrusions (212) are engaged with the latch holes (221) on the metallic rear shell (22).

12. A high definition multimedia interface (HDMI) connector as claimed in claim 1, wherein the metallic rear shell (22) is a rectangular body having a hollow front portion and a hollow cylinder at rear part with a sufficient space to receive the cablings, and the latch holes (221) are furnished at the front end of both top and bottom wide surface, the slanting inward projections (222) are furnished at both sides of the narrow surface.

13. A high definition multimedia interface (HDMI) connector as claimed in claim 12, wherein the positions of the latch holes (221) and the protrusions (212) on the metallic front shell (21) are correspondingly matched to form a retaining means.

14. A high definition multimedia interface (HDMI) connector as claimed in claim 12, wherein the slanting inward projection (222) is engaged in the rectangular end side of the received metallic front shell (21) to prevent the front and metallic rear shell (21), (22) from further longitudinal displacement.

15. A high definition multimedia interface (HDMI) connector as claimed in claim 1, wherein the plastic outer shell (30) is adapted to receive the metallic rear shell (22) containing the metallic front shell (21) for firmly covering the both, and a plurality of notches (31) are furnished on the front end of the top and bottom sides of the plastic outer shell (30).

16. A high definition multimedia interface (HDMI) connector as claimed in claim 1, wherein the front cover (40) has an opening similar to the insertion portion (11) and metallic front shell (21), so it may confine the rear part of the metallic front shell (21) and retain the metallic front shell (21) at the rectangular part of the same, and a plurality of buckles (41) are furnished on the top and bottom sides of the frame of the front cover (40).

17. A high definition multimedia interface (HDMI) connector as claimed in claim 1, wherein the number and position of the notches (31) and the buckle (41) on the front cover (40) are correspondingly matched to form a retaining means.

* * * * *